US007004007B2

(12) United States Patent
Kruger et al.

(10) Patent No.: US 7,004,007 B2
(45) Date of Patent: Feb. 28, 2006

(54) DIE CUSHION APPARATUS FOR HOT STRETCH-FORMING

(75) Inventors: Gary A. Kruger, Troy, MI (US); Mark G. Konopnicki, Rochester, MI (US); Richard Harry Hammar, Utica, MI (US)

(73) Assignee: General Motors Corporation, Detroit, MI (US)

( * ) Notice: Subject to any disclaimer, the term of this patent is extended or adjusted under 35 U.S.C. 154(b) by 286 days.

(21) Appl. No.: 10/685,256

(22) Filed: Oct. 14, 2003

(65) Prior Publication Data

US 2005/0076699 A1 Apr. 14, 2005

(51) Int. Cl.
*B21J 9/18* (2006.01)

(52) U.S. Cl. ..... 72/453.13; 72/344; 72/350; 72/351; 72/456; 384/9; 384/57; 384/905; 29/434; 29/321; 29/322; 29/323; 29/324; 29/325; 100/315

(58) Field of Classification Search ..... 29/434; 72/351, 453.13, 456, 350; 100/269.17, 315, 100/321, 322–325; 384/9, 57, 905
See application file for complete search history.

(56) References Cited

U.S. PATENT DOCUMENTS 4,732,033 A * 3/1988 Smedberg et al. ..... 72/453.13
6,237,381 B1 * 5/2001 Smedberg et al. ..... 72/19.9
6,804,983 B1 * 10/2004 Mori et al. ..... 72/350

* cited by examiner

*Primary Examiner*—Derris H. Banks
*Assistant Examiner*—Hung C. Le
(74) *Attorney, Agent, or Firm*—Kathryn A. Marra

(57) ABSTRACT

A self-contained die cushion assembly for use in a stretch-forming process involving heated tooling. A lower plate is mounted below an upper plate that undergoes different thermal expansion than the lower plate. Guidance devices are mounted between the upper and lower plates and include a guide post, a bearing sleeve circumscribing the guide post, and a cylinder circumscribing the bearing sleeve. The guide post is mounted in fixed relation to the upper plate, and the cylinder is mounted in laterally translatable relation to the lower plate to accommodate lateral relative displacement between the upper and lower plates due to different thermal expansion thereof, thereby preventing binding of the guidance devices.

17 Claims, 4 Drawing Sheets

DIE CUSHION APPARATUS FOR HOT STRETCH-FORMING

TECHNICAL FIELD

This invention pertains to apparatus for metal deforming. More specifically, this invention pertains to a self-contained die cushion assembly for use with hot stretch-forming operations such as super-plastic-forming (SPF) or quick-plastic-forming (QPF) processes.

BACKGROUND OF THE INVENTION

In conventional stamping processes, it is often desirable to hold a blank sheet of metal about its peripheral margin during forming of a stamped component. In such processes, it is known to provide a female form die mounted to a movable upper platen of a press, a male form punch fixedly mounted to a fixed lower platen of the press, and a binder ring displaceably mounted to the press. The binder ring encircles the form punch and is positioned vertically flush with respect thereto, such that the blank sheet of metal can be laid flat across the binder ring and the form punch. In operation, the upper platen strokes downwardly, wherein the form die pinches the peripheral margin of the blank sheet of metal against the binder ring and displaces the binder ring downwardly so as to stretch the blank sheet of metal over the form punch to produce the stamped component. The binder ring and its displaceable mounting structure are often known as a die cushion.

Die cushion apparatuses are widely used in conventional stamping processes for manufacturing automotive body panels. Die cushion apparatuses are often integrated into a press machine and may be used in stripping finished parts from a punch or a die, and in actuating ejector pins that push a finished part from a die cavity or from a die punch. Also, in double-action presses, die cushion apparatuses are often used to keep a sheet metal blank flat, to hold the blank to shape, or to prevent the blank from slipping and distorting during drawing. Moreover, in single-action presses, die cushion apparatuses enable relatively uniform blankholding force. In a single-action press using a die cushion apparatus, a die punch is mounted on a lower plate of the die cushion apparatus and a form die is mounted above an upper plate of the die cushion apparatus. Cushion cylinders are mounted between the upper and lower plates of the die cushion apparatus for applying an upward bias force against the upper plate to hold an outer portion of a sheet metal blank against the form die during a downward stroke of the form die.

Die cushion apparatuses can also be mounted to a press machine as a self-contained assembly that is adapted for use in hot stretch-forming processes for manufacturing automotive body panels. Hot stretch-forming processes may include super-plastic-forming and quick-plastic-forming processes in which a sheet metal blank is pinched at its periphery between complementary surfaces of opposed die members of a press machine. For example, a lower platen of the press machine may carry a die cushion assembly having upper and lower plates connected by guidance cylinders, which are fixed to the upper and lower plates at the corners thereof. In any case, a male punch is typically mounted to the lower plate of the die cushion assembly and a binder ring is typically carried by the upper plate of the die cushion assembly. An upper platen of the press may carry a female preform tool, wherein the sheet metal blank becomes pinched between the preform tool and the binder ring to form a pressure tight seal between the sheet metal blank and the preform tool. Accordingly, the preform tool also serves as a pressure flask or vessel. The preform tool design typically includes a cavity for clearance fit operation with the male punch and the design minimizes the volume of the cavity between the preform tool and male punch. This reduces the required super-plastic-forming pressure to about 400 psi and improves radiant heating of the sheet metal blank by minimizing the distance therefrom to the preform tool.

To provide the heat necessary for stretch-forming, electrical heating elements are typically located in the female preform tool and binder ring as well as in the male punch. The electrical heating elements primarily heat the male and female tooling, but also tend to incidentally heat the upper and lower plates of the die cushion assembly. Unfortunately, however, the temperatures of the upper plate and the lower plate of the die cushion tend to be significantly different due to differences in the heat generated by the electrical resistance heating elements or by differences in residual heat generated during the forming process. Such differences in temperature between the upper and lower plates tend to yield different thermal expansion characteristics thereof. For example, forming process temperatures tend to be greatest near the upper plate, thereby leading to greater displacement thereof due to relatively greater thermal expansion of the upper plate compared to the lower plate. In other words, the upper plate tends to expand outwardly to a greater degree than the lower plate, and the upper plate thereby urges the upper end of the guidance cylinders in a direction laterally away from the lower end of the guidance cylinders, thereby leading to binding of the guidance cylinders and inoperability of the die cushion assembly.

Thus, there is a need to eliminate binding of guidance cylinders between upper and lower plates of a die cushion assembly.

SUMMARY OF THE INVENTION

The present invention meets the above-mentioned need by providing an improved die cushion assembly for use in a hot stretch-forming process for producing a stretch-formed component. In a representative hot-stretch forming operation, a movable upper platen of a press carries a female form die, whereas a fixed lower platen of the press carries a die cushion assembly having a solid lower plate mounted to the fixed lower platen and having a ring-like upper plate displaceably mounted to the lower plate of the die cushion assembly. The upper plate is mounted to the lower plate by cushion devices that upwardly bias the upper plate away from the lower plate and by guidance devices that ensure true vertical alignment between the upper and lower plates. Opposite the female form die, a male form punch is fixedly mounted to the lower plate of the die cushion, and a binder ring is mounted to the upper plate of the die cushion. The binder ring encircles the male form punch and is positioned vertically flush with respect thereto, such that a blank sheet of metal can be laid flat across the binder ring and the form punch. In operation, the upper platen strokes downwardly, wherein the form die pinches the peripheral margin of the blank sheet of metal against the binder ring and downwardly displaces the binder ring and upper plate of the die cushion so as to stretch the blank sheet of metal over the form punch to produce the stretch-formed component.

The improved die cushion assembly of the present invention includes improved guidance devices that are laterally translatably mounted between plates of the die cushion assembly and that are strategically positioned within the die cushion assembly. The improved guidance devices are positioned along the side of the upper and lower plates of the die cushion assembly instead of at the corners thereof. The improved guidance devices also includes mounting structure that permits lateral displacement of the guidance devices without binding thereof. Accordingly, the present invention accommodates differences in thermal expansion of the plates and thereby maintains precise location and alignment between the plates.

The practice of this invention is particularly useful in hot stretch-forming of any sheet metal having suitable ductility at an elevated temperature for such plastic deformation. Various aluminum, magnesium, titanium, and ferrous alloys can be processed into sheets having a ductile metallurgical structure. Usually the sheets are formed by hot rolling a cast billet to a strip and then cold rolling the strip to a sheet of desired thickness and surface finish. Depending upon the material, the cold worked sheets may then be heat treated to provide the necessary ductility. For example, magnesium-containing aluminum alloys display tensile elongations in excess of 300% at forming temperatures in the range of 450° to 500° C. and have been formed into automotive body panels such as deck lid outer panels. For such a material, this invention is typically practiced by preheating the sheet to about 500° C. and maintaining a preform die at the same temperature and a punch at about 440° C.

According to a first aspect of the present invention, there is provided a die cushion apparatus for use in a stretch-forming process involving heated tooling. The die cushion apparatus includes a lower plate, an upper plate that undergoes different thermal expansion than the lower plate, and guidance devices mounted between the upper and lower plates. The guidance devices include a guide post, a bearing sleeve circumscribing at least a portion of the guide post, and a cylinder circumscribing at least a portion of the bearing sleeve. One of the guide post or cylinder is mounted in fixed relation to one of the upper and lower plates, and the other of the guide post or the cylinder is mounted in laterally translatable relation to the other of the upper and lower plates to accommodate lateral relative displacement between the upper and lower plates due to different thermal expansion thereof, thereby preventing binding of the plurality of guidance devices.

According to a second aspect of the present invention, there is provided a guidance device for mounting between upper and lower plates of a die cushion apparatus for a hot stretch-forming process, wherein the upper plate undergoes different thermal expansion than the lower plate. The guidance device includes a guide post, a bearing sleeve circumscribing the guide post, and a cylinder circumscribing the bearing sleeve. One of the guide post and the cylinder is mounted in fixed relation to one of the upper and lower plates, and the other of the guide post and the cylinder is mounted in laterally translatable relation to the other of the upper and lower plates to accommodate lateral relative displacement between the upper and lower plates due to different thermal expansion thereof, thereby preventing binding of the guide post within the cylinder.

BRIEF DESCRIPTION OF THE DRAWINGS

These and other features and advantages of the invention will become apparent upon reading the detailed description in combination with the accompanying drawings, in which.

DESCRIPTION OF THE PREFERRED EMBODIMENT

The present invention has application in hot stretch-forming processes, particularly those processes capable of producing articles of complex shape, such as automotive body panels. More particularly, the present invention is directed to such hot stretch-forming processes that use a self-contained die cushion or extraction apparatus.

Figure 1:
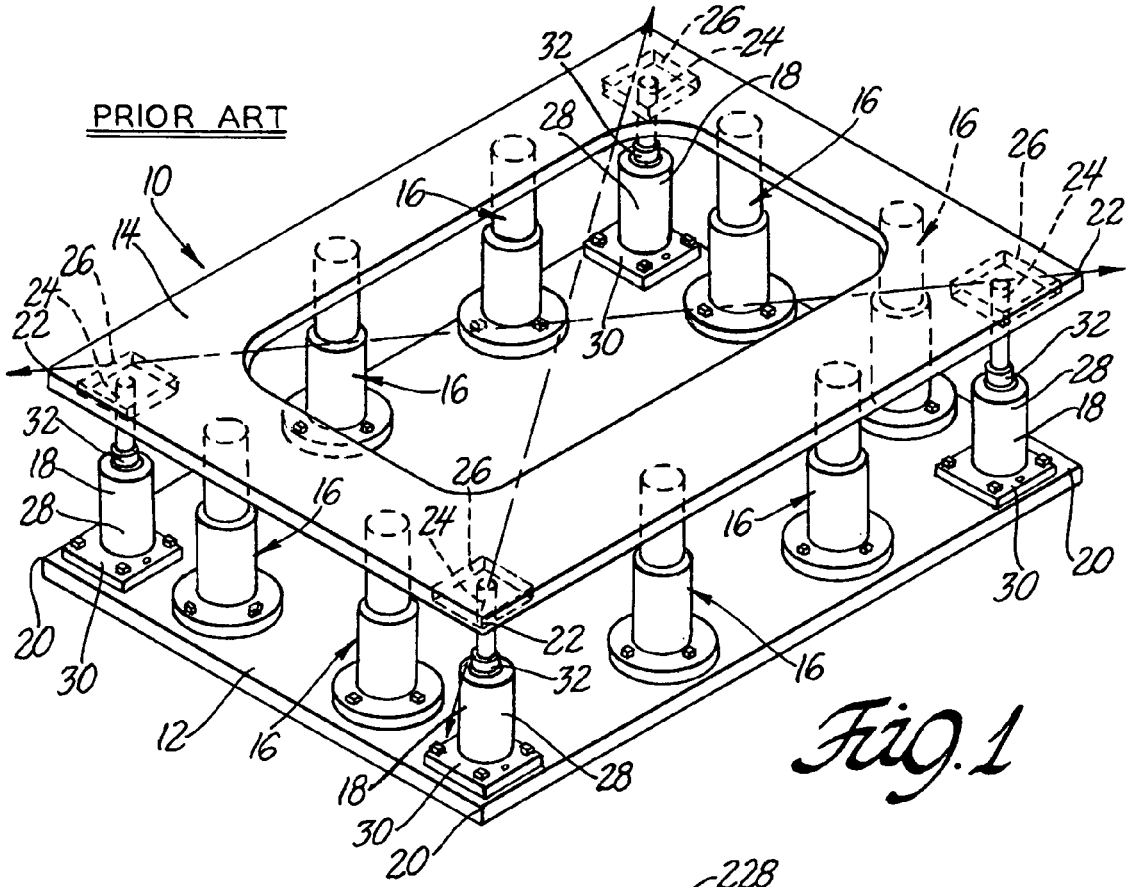
FIG. 1 is perspective view of a die cushion assembly according to the prior art.

FIG. 1 illustrates a die cushion assembly 10 according to the prior art. The die cushion assembly 10 includes a lower plate 12, an upper plate 14, and a plurality of cushion devices 16 and guidance devices 18 fixedly mounted therebetween. The cushion devices 16 are positioned in the margins of the upper and lower plates 12, 14 along the sides thereof, laterally between the guidance devices 18. The guidance devices 18, however, are immovably fixed at positions between respective lower and upper corners 20, 22 of the lower and upper plates 12, 14 for maintaining alignment of the upper plate 14 with respect to the lower plate 12. The guidance devices 18 have posts 24 that are welded to bases 26, which are welded or otherwise fastened to the upper plate 14. Similarly, the guidance devices 18 have cylinders 28 that are welded to flanges 30, which are fastened to the lower plate 12. The posts 24 are rigidly mounted to the cylinder 28 with bearing sleeves 32 therebetween, such that there is no lateral translation between the posts 24 and cylinders 28 or between the posts 24 and the plates 12, 14.

The die cushion assembly 10 is intended for use within a hot stretch-forming press machine (not shown), as will be described in more detail below in reference to the present invention. Using quick-plastic-forming (QPF) techniques developed by the assignee hereof, hot stretch-forming apparatuses are now built to incorporate heating elements embedded directly within die tooling (not shown), rather than within the press machine itself, thereby yielding lower ambient temperatures within the press machine. Accordingly, lower ambient temperatures enable use of auxiliary press mechanisms such as the die cushion assembly 10.

Despite reduced ambient temperatures and, thus, relatively small temperature differences between the lower and upper plates 12, 14, there still exists a problem with elongation or expansion of relatively large tooling plates, such as those used for die cushion assemblies for making automotive body panels. The upper and lower plates 12, 14 of the die cushion assembly 10 are typically attached to electrically heated tooling (not shown) that is used to generate the heat to carry out the hot stretch-forming process. The heated tooling often transmits heat into the lower and upper plates 12, 14, despite the presence of insulation layers (not shown) disposed therebetween.

Unfortunately, the upper plate 14 tends to absorb and retain significantly more heat than the lower plate 12, thereby leading to relatively greater thermal expansion of the upper plate 14 compared to the lower plate 12. Typically, the upper plate 14 tends to expand in a lateral direction on the order of about 4 to 5 mm. This difference in thermal expansion results in the guidance devices 18 being relatively stationary where attached to the lower plate 12, but being displaced laterally outwardly where attached to the upper plate 14 due to the outward thermal expansion of the upper plate 14. This condition thereby leads to binding of the guidance devices 18 and, thus, inoperability of the die cushion assembly 10. Accordingly, the hot stretch-forming press may not open and close properly and the guidance devices 18 may wear out prematurely. This problem is exacerbated by the inconvenient location of the guidance devices 18 at the corners 20, 22 of the lower and upper plates 12, 14. As indicated by the diagonally extending dashed lines 34, the greatest amount of expansion accumulates diagonally across the upper plate 14. Therefore, the corners 22 of the upper plate 14 undergo the most lateral displacement.

Therefore, in accordance with the present invention, it is desirable to relocate the guidance devices 18 from the corners 20, 22 of the plates 12, 14 to midpoints along the sides of the plates 12, 14, and to provide a scheme for attaching the alignment devices 18 in a forgiving manner between the plates 12, 14. Such a die cushion assembly 210 according to the present invention is depicted in FIGS. 2 and 3.

Figure 2:
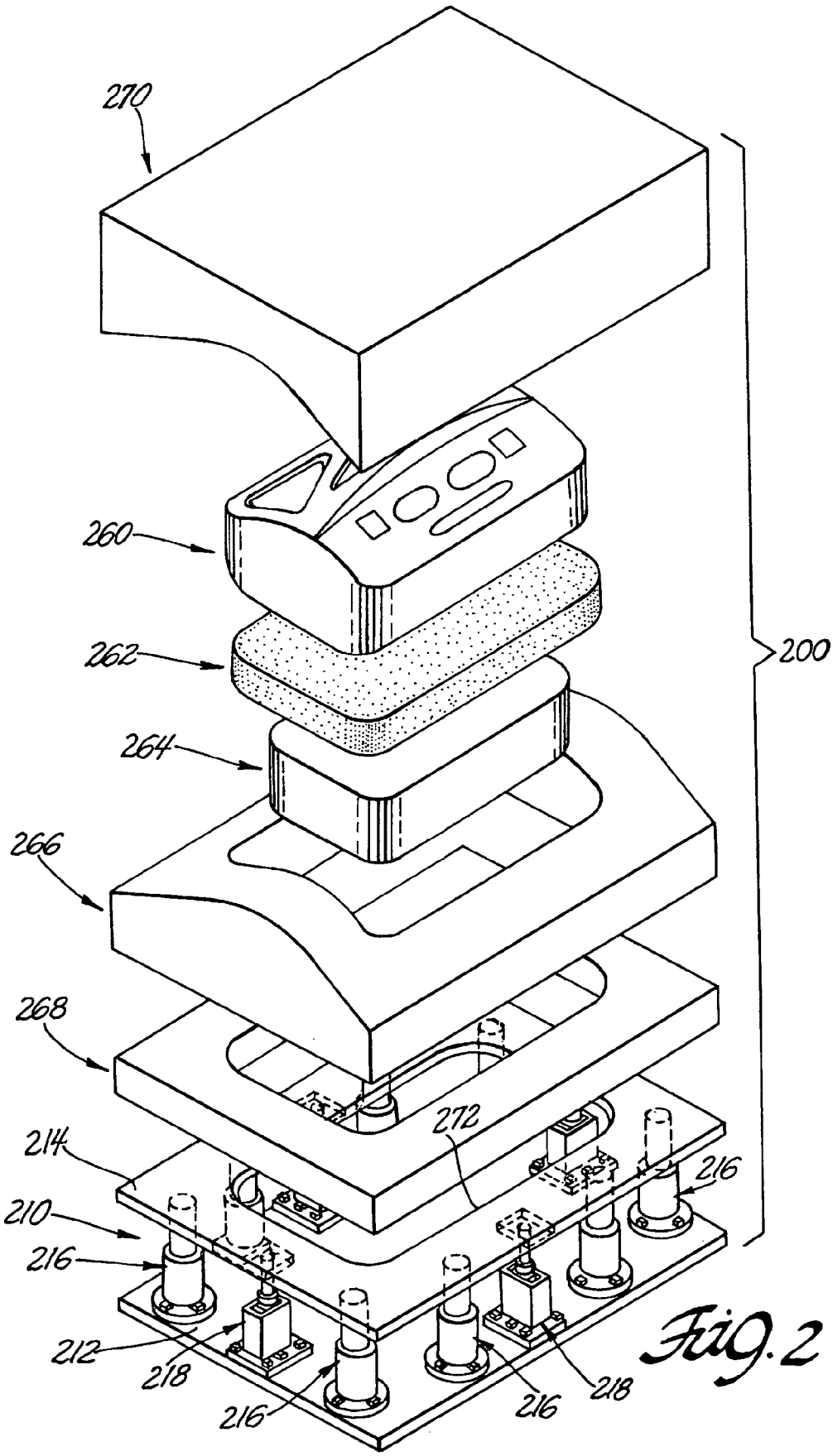
FIG. 2 is an exploded perspective view of various hot stretch-forming tooling and a die cushion assembly according to the present invention.

FIG. 2 illustrates tooling 200 for use in a hot stretch-forming process on a single-action press (not shown) including the die cushion assembly 210 as well as various other tooling that will be described in greater detail below. The die cushion assembly 210 includes a lower plate 212, an upper plate 214, a plurality of cushion devices 216 fixedly mounted to the lower plate 212 for supporting and biasing the upper plate 214 away from the lower plate 212, and a plurality of alignment or guidance devices 218 fixedly mounted to the upper plate 214 and laterally translatably mounted to the lower plate 212 for maintaining precise lateral alignment between the lower and upper plates 212, 214.

Figure 3:
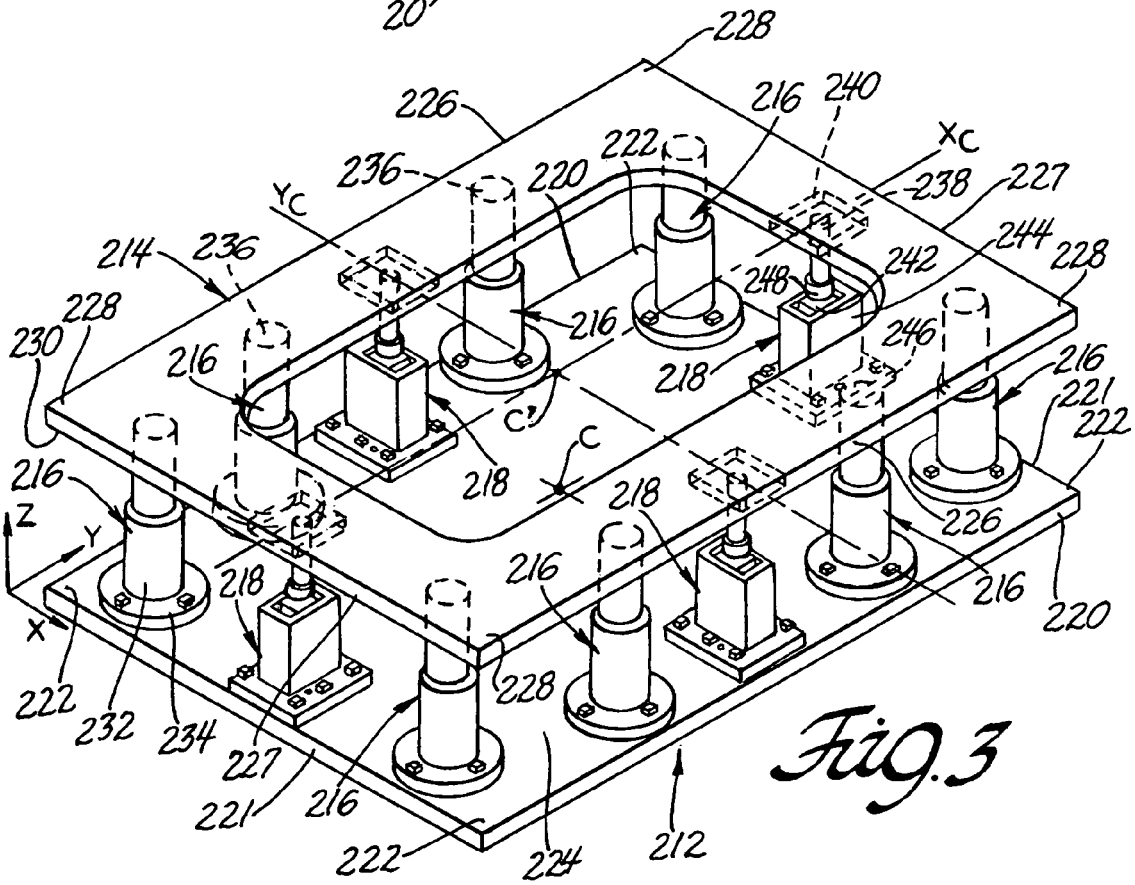
FIG. 3 is a perspective view of the die cushion assembly illustrated in FIG. 2.

Referring now to FIG. 3, the lower and upper plates 212, 214 may be composed of a metal material such as steel for strength and durability. The lower plate 212 is typically mounted to a lower platen of a press machine with a layer of insulation disposed therebetween (not shown). The lower plate is rectangular in shape with a solid continuous body having sides 220, 221, corners 222, and a top surface 224. Similarly, the upper plate 214 is rectangular in shape including sides 226, 227, corners 228, and a bottom surface 230. The lower and upper plates 212, 214 may be water cooled such that they are jacketed with water passages (not shown) therethrough, such as by gun drilling.

The cushion devices 216 are fixedly positioned in the margins of the lower and upper plates 212, 214 along the sides 220, 221, 226, 227 thereof. The cushion devices 216 are provided for biasing the lower and upper plates 212, 214 a predetermined distance apart and have cylinders 232 with mounting flanges 234 that are fixedly mounted to the top surface 224 of the lower plate 212, such as by fasteners like bolts, cap screws, and the like. As is well known in the art, the cushion devices 216 may be hydraulic or pneumatic cylinders, nitrogen gas filled cylinders, high rate coil spring cylinders, and the like. In any case, the cushion devices 216 include pistons 236 that are freely biased against the bottom surface 230 of the upper plate 214 to maintain the upper plate 214 a predetermined distance apart from the lower plate 212. Typically, the cushion devices 216 accommodate a vertical stroke of 5 to 15 mm when the die cushion assembly is used for extraction applications and a stroke of 5 to 50 mm when the die cushion assembly is used for stretch forming applications. The pistons 236 are not secured to the upper plate 214 and, thus, when the upper plate 214 expands in a lateral direction, the cushion devices 216 do not bind. In any event, the cushion devices 216 are sensitive and intolerant to lateral displacement and, thus, cannot be secured to both the upper and lower plates 214, 212. The cushion devices 216 are positioned around the peripheries or margins of the plates 212, 214 as shown, and may, but need not be positioned at the corners 222, 228 thereof.

The guidance devices 218 are laterally translatably mounted at positions between the lower and upper plates 212, 214 for maintaining alignment of the upper plate 214 with respect to the lower plate 212. In contrast to the cushion devices 216, the guidance devices 218 are positioned in the margins of the plates, midway along the sides 220, 221, 226, 227 of the plates 212, 214 and between the corners 222, 228 thereof. In other words, the guidance devices 218 are positioned along X and Y axis centerlines Xc, Yc of the plates 212, 214. Accordingly, the guidance devices 218 are repositioned, compared to the prior art of FIG. 1, to locations that undergo relatively less linear thermal expansion or elongation. Moreover, the locations of the guidance devices 218 tend to confine lateral expansion of the plates 212, 214 along the respective X and Y axes, while maintaining the respective centerlines between the lower and upper plates 212, 214, such that a center C' of the X-Y plane of the upper plate 214 remains centered above a center C of the X-Y plane of the lower plate 212. Basically, the guidance devices 218 are provided for ensuring smooth motion along the Z axis between the lower and upper plates 212, 214 and for maintaining alignment between the plates 212, 214 such that there is little to no relative lateral motion therebetween in the X or Y axial directions.

Still referring to FIG. 3, the guidance devices 218 have upper ends defined by posts 238 and bases 240 that are welded together, wherein the bases 240 are welded or otherwise fastened to the upper plate 214. The guidance devices 218 have cylinders or rectangular sleeves 242 that laterally translatably mount within rectangular mounting blocks 244, which are welded to mounting flanges 246 that fasten to the lower plate 212. The posts 238 are rigidly mounted within the sleeves 242 with bearing sleeves 248 therebetween, such that there is no lateral translation between the posts 238 and sleeves 242. Different mounting arrangements of the guidance devices 218 are best shown in FIGS. 4A through 6B.

Figure 4A:
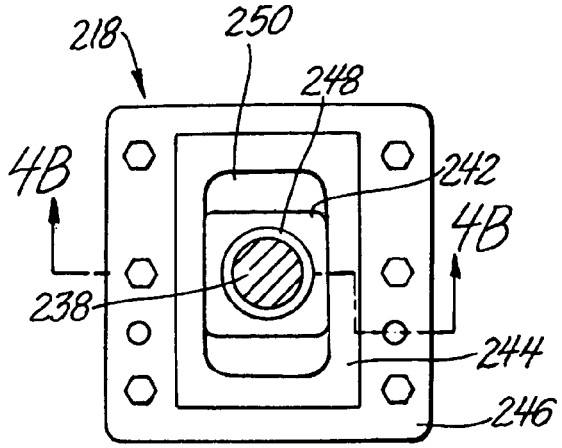
FIG. 4A is a cross-sectional view of the guidance device of FIG. 4B taken along line 4A—4A.
Figure 4B:
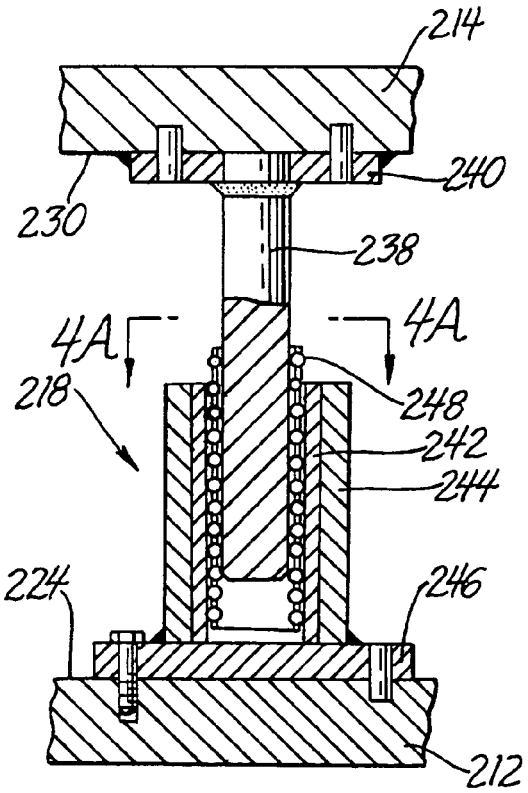
FIG. 4B is an elevational cross-sectional view of a guidance device of the die cushion assembly of FIG. 3.

FIGS. 4A and 4B illustrate an embodiment of a guidance device 218 according to the present invention. FIG. 4B illustrates the lower plate 212, upper plate 214, and one of the guidance devices 218 mounted therebetween. The guidance device 218 includes the guide post 238 that is preferably composed of steel and is welded, press-fit, staked, or otherwise affixed to the base 240, which in turn is doweled and welded to the bottom surface 230 of the upper plate 214. The guidance device 218 further includes the bearing sleeve 248 circumscribing the guide post 238, the square sleeve 242 mounted within the rectangular mounting block 244, and the mounting flange 246 welded to the mounting block 244 and fastened to the top surface 224 of the lower plate 212.

As also shown in the cross section of FIG. 4A, the guide post 238 fits inside the bearing sleeve 248, which in turn is circumscribed by the square sleeve 242. The bearing sleeve 248 is preferably a linear bearing, such as a THOMSON linear bearing available from Danaher Linear Motion Systems of Port Washington, N.Y. The square sleeve 242 is loosely mounted within an interior 250 of the rectangular mounting block 244, such that there is a clearance fit therebetween. Thus, the square sleeve 242, bearing sleeve 248, and guide post 238 are free to translate laterally back and forth within the interior 250 of the rectangular mounting block 244 when the upper plate 214 undergoes thermal expansion and thereby displaces the guide post 238 in a lateral direction. In other words, the guidance devices 218 are laterally translatably mounted between the lower and upper plates 212, 214 to accommodate lateral displacement therebetween.

Figure 5A:
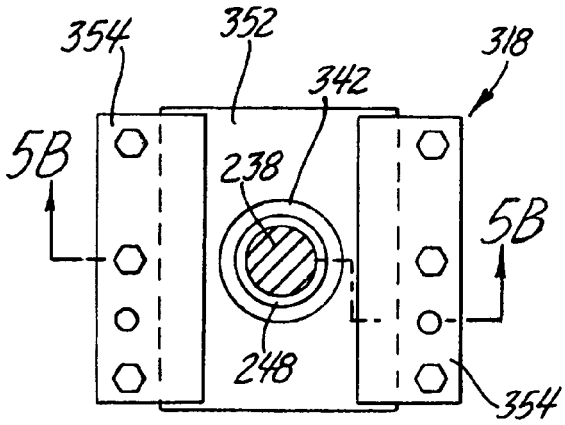
FIG. 5A is a cross-sectional view of the guidance device of FIG. 5B taken along line 5A—5A.
Figure 5B:
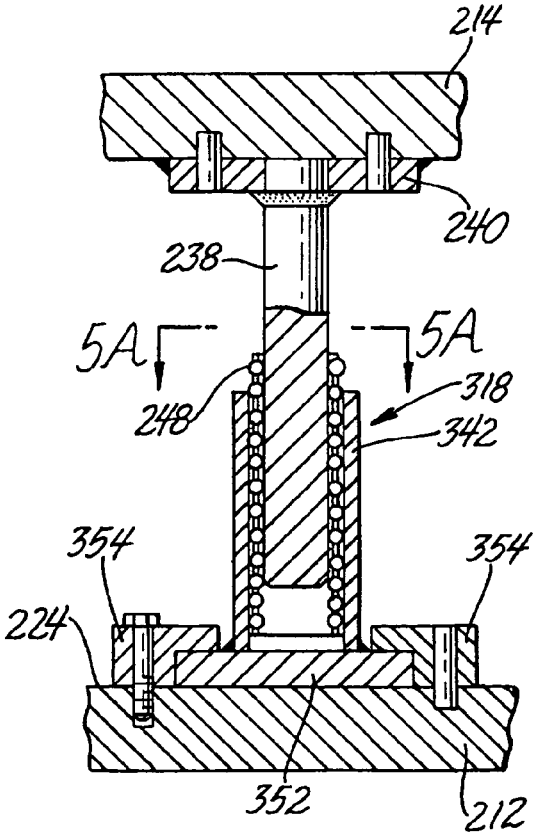
FIG. 5B is an elevational cross-sectional view of a guidance device according to an alternative embodiment of the present invention.

FIGS. 5A and 5B illustrate another embodiment of a guidance device 318 according to the present invention. The base 240, guide post 238, and bearing sleeve 248 are identical to that described with reference to FIGS. 4A and 4B. A guide cylinder or sleeve 342, however, is different from that described in FIGS. 4A and 4B in that the sleeve 342 is welded to a planar flange member 352 that is freely translatably retained by opposed retainer plates or blocks 354, which are doweled and fastened to the upper surface 224 of the lower plate 212. In other words, there is a clearance fit between the flange member 352 and the retainer blocks 354. Those skilled in the art will recognize that the retainer blocks 354 could be integrated into a single component if desired. Accordingly, as the upper plate 214 undergoes thermal expansion and tends to pull the upper end of the guidance device 318, the bottom end of the guidance device 318 (defined by the flange member 352) is free to translate to prevent binding of the guidance device 318.

Figure 6A:
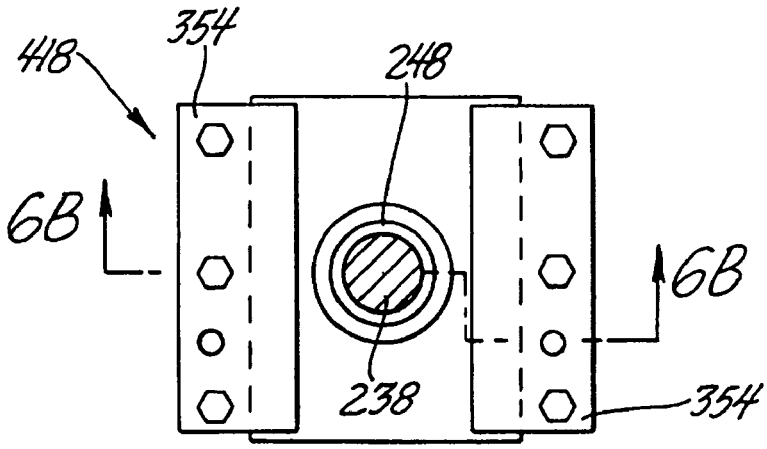
FIG. 6A is a cross-sectional view of the guidance device of FIG. 6B taken along line 6A—6A.
Figure 6B:
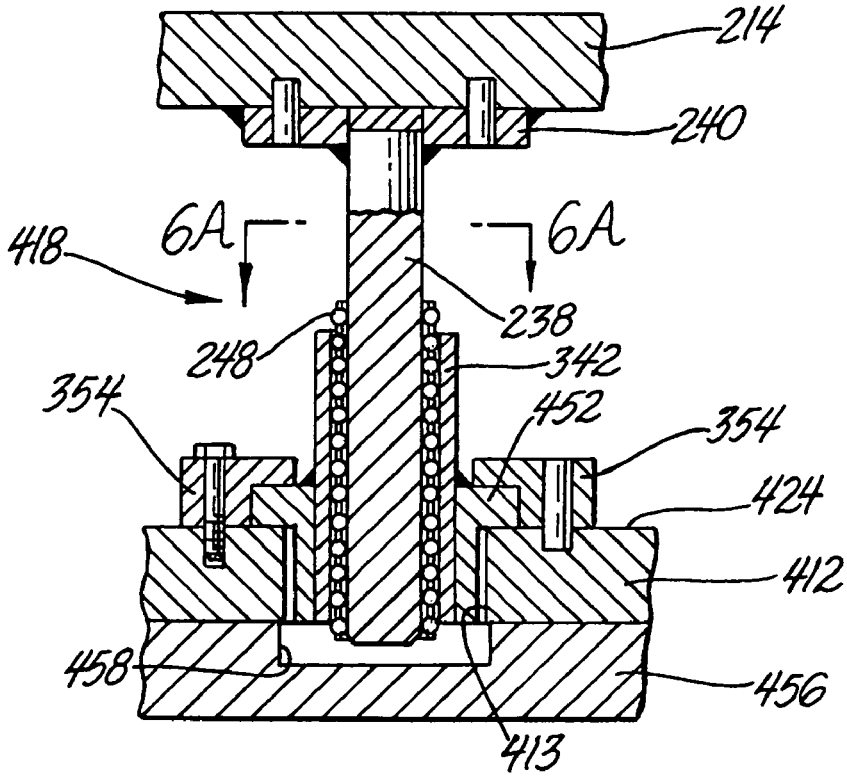
FIG. 6B is an elevational cross-sectional view of a guidance device according to another alternative embodiment of the present invention.

FIGS. 6A and 6B illustrate yet another embodiment of a guidance device 418 according to the present invention. Again, the base 240, guide post 238, and bearing sleeve 248 are identical to that described with reference to FIGS. 4A–5B. Similarly, the sleeve 342 and retainer blocks 354 are identical to that disclosed in FIGS. 5A–5B. But, the sleeve 342 is welded to a T-shaped flange member 452 that is freely translatably retained by the retainer blocks 354 that are doweled and fastened to an upper surface 424 of a lower plate 412. In other words, there is a clearance fit between the T-shaped flange member 452 and the retainer blocks 354. Also, the lower plate 412 includes an aperture 413 therethrough to permit the bearing sleeve 248 to traverse and extend therethrough. Moreover, a subplate 456, to which the lower plate 412 is mounted, includes a void 458 machined therein to provide clearance for increased vertical travel of the guide post 238. Accordingly, the space between the upper plate 214 and lower plate 412 can be reduced compared to the previously disclosed embodiments, thereby reducing the inertial moment between the guide post 238 and the bearing sleeve and 248 and sleeve 342.

Referring again to the tooling 200 of FIG. 2, an integrally heated form punch 260 is mounted to the lower plate 212 of the die cushion assembly 210 with a block of load bearing insulation 262 and a punch pedestal 264 positioned therebetween. Likewise, an integrally heated binder ring 266 is mounted to the upper plate 214 of the die cushion assembly 210 with a ring of load bearing insulation 268 disposed therebetween. Finally, a female forming die 270 is disposed over the binder ring 266 for downward contact therewith during the hot stretch-forming process.

The upper plate 214 of the die cushion assembly 210 includes an aperture 272 formed therethrough for operative clearance with the form punch 260. Likewise, the binder ring 266 is also apertured for clearance with the form punch 260. As mentioned previously above, with reference to FIG. 3, the centers of the lower plates and upper 212, 214 are maintained in vertical alignment by the present invention. Accordingly, the present invention ensures that the form punch 260 may freely pass through the aperture 272 of the upper plate 214 without any interference therewith, but rather, with a uniform peripheral gap therebetween.

The press tooling consisting of the forming die 270, binder ring 266, and form punch 260 are all provided with electrical heating elements (not shown) disposed therein, as is known in the art. The heating elements are provided for maintaining the tooling at a temperature suitable for hot stretch-forming sheet material such as aluminum AA5083, 5182, 5454, and the like. The heating elements are suitably commercially available electrical resistance heaters that are connected to suitably available electric power supplies and control units (not shown).

While the heating elements may be of like construction and function, it is often preferred to connect the heating elements according to different control zones having different temperatures. It is preferred to control the temperature of the female forming die 270 to a different value than that of the form punch 260. For example, it may be desirable to maintain the female forming die 270 at a temperature of about 500° C. and the form punch 260 at about 440° C. The heat generated during the process tends to distort various tooling used in carrying out the process and such heat distortion is particularly manifested in the form of thermal expansion across large tooling plates such as the lower and upper plates 212, 214 of the die cushion assembly 210.

Although the die cushion assembly 210 is well insulated from direct contact with the heated tooling, it still absorbs heat from the heated tooling by convection, conduction, or both. Accordingly, the temperature of the die cushion assembly 210 typically reaches between 100°–160° F., which is sufficient to cause the relatively large upper plate 212 to expand to the point of binding the guidance devices 218, in the absence of the present invention. The upper plate 214 tends to be in closer proximity to the heated tooling than the lower plate 212 and the upper plate 214 has less mass than the lower plate 212. Thus, the upper plate 214 tends to absorb and retain more heat than the lower plate 212.

Thus, the present invention focuses on accommodating thermal expansion between different tool members due to the thermal effects that hot stretch-forming operations. The present invention accomplishes this by providing an improved die cushion assembly, wherein improved guidance devices are laterally translatably mounted between plates of the die cushion assembly and are strategically positioned within the die cushion assembly, for accommodating different thermal expansion of the upper and lower plates.

It should be understood that the invention is not limited to the embodiments that have been illustrated and described herein, but that various changes may be made without departing from the spirit and scope of the invention. For example, the die cushion apparatus disclosed herein has upper and lower plates that are generally rectangular in shape. But the plates may take any shape and form so long as the guidance devices are laterally translatably mounted therebetween in positions that optimize the ability to maintain the centers of the plates in lateral alignment. Accordingly, it is intended that the invention not be limited to the disclosed embodiments, but that it have the full scope permitted by the language of the following claims.

What is claimed is:

1. A die cushion apparatus for use in a stretch-forming process involving heated tooling, said die cushion apparatus comprising:

a lower plate;

an upper plate that undergoes different thermal expansion than said lower plate; and a plurality of guidance devices mounted between said upper and lower plates, said plurality of guidance and including:

a guide post;

a bearing sleeve circumscribing at least a portion of said guide post; and a cylinder circumscribing at least a portion of said bearing sleeve;

wherein one of said guide post and said cylinder is mounted in fixed relation to one of said upper and lower plates, and the other of said guide post and said cylinder is mounted in laterally translatable relation to the other of said upper and lower plates to accommodate lateral relative displacement between said upper and lower plates due to different thermal expansion thereof, thereby preventing binding of said plurality of guidance devices.

2. The die cushion apparatus as recited in claim 1, wherein said upper and lower plates include corners and substantially opposed sides, further wherein said plurality of guidance devices are positioned laterally along said sides of said upper and lower plates and not at said corners of said upper and lower plates.

3. The die cushion apparatus as recited in claim 2, wherein said plurality of guidance devices are positioned substantially at midpoints along said sides of said upper and lower plates.

4. The die cushion apparatus as recited in claim 3, wherein said plurality of guidance devices include two opposed pairs of guidance devices, each of said two opposed pairs being substantially aligned along a respective centerline of said die cushion apparatus along a respective axis.

5. The die cushion apparatus as recited in claim 1, wherein said cylinder is translatably mounted to said lower plate.

6. The die cushion apparatus as recited in claim 5, wherein said plurality of guidance devices further include a rectangular mounting block having a mounting flange that is fastened to said lower plate, wherein said cylinder is mounted within said rectangular mounting block and is laterally translatable therein.

7. The die cushion apparatus as recited in claim 5, wherein said plurality of guidance devices further includes a mounting flange attached to said cylinder and mounted against said lower plate and retainer blocks that are attached to said lower plate and that loosely capture said mounting flange therebetween to permit said cylinder to be laterally translatable with respect to said lower plate.

8. The die cushion apparatus as recited in claim 5, wherein said lower plate includes at least one aperture therethrough, and said plurality of guidance devices further includes a T-shaped mounting flange attached to said cylinder and mounted against said lower plate and extends at least partially through said at least one aperture of said lower plate, said plurality of guidance devices further includes retainer blocks that are attached to said lower plate and that loosely capture said T-shaped mounting flange therebetween to permit said cylinder to be laterally translatable with respect to said lower plate.

9. A self-contained die cushion assembly for use in a stretch-forming process involving heated tooling, said self-contained die cushion assembly comprising:

a lower plate having corners and sides;

an upper plate that undergoes different thermal expansion than said lower plate, said upper plate having corners and sides; and a plurality of guidance devices mounted between said upper and lower plates, said plurality of guidance devices being positioned substantially at midpoints of said sides of said upper and lower plates and not at said corners of said upper and lower plates, said plurality of guidance devices including:

a guide post;

a bearing sleeve circumscribing at least a portion of said guide post; and a cylinder circumscribing at least a portion of said bearing sleeve;

wherein said guide post is mounted in fixed relation to said upper plate, and said cylinder is mounted in laterally translatable relation to the said lower plate to accommodate lateral relative displacement between said upper and lower plates due to different thermal expansion thereof from heat generated by said heated tooling, thereby preventing binding of said guide post within said cylinder.

10. The self-contained die cushion assembly as recited in claim 9, wherein said plurality of guidance devices further include a rectangular mounting block having a mounting flange that is fastened to said lower plate, wherein said cylinder is mounted within said rectangular mounting block and is laterally translatable therein.

11. The die cushion apparatus as recited in claim 9, wherein said plurality of guidance devices further includes a mounting flange attached to said cylinder and mounted against said lower plate and retainer blocks that are attached to said lower plate and that loosely capture said mounting flange therebetween to permit said cylinder to be laterally translatable with respect to said lower plate.

12. The die cushion apparatus as recited in claim 9, wherein said lower plate includes at least one aperture therethrough, and said plurality of guidance devices further includes a T-shaped mounting flange attached to said cylinder and mounted against said lower plate and extends at least partially through said at least one aperture of said lower plate, said plurality of guidance devices further includes retainer blocks that are attached to said lower plate and that loosely capture said T-shaped mounting flange therebetween to permit said cylinder to be laterally translatable with respect to said lower plate.

13. A guidance device for mounting between upper and lower plates of a die cushion apparatus for a hot stretch-forming process wherein said upper plate undergoes different thermal expansion than said lower plate, said guidance device including:

a guide post;

a bearing sleeve circumscribing at least a portion of said guide post; and a cylinder circumscribing at least a portion of said bearing sleeve;

wherein one of said guide post and said cylinder is mounted in fixed relation to one of said upper and lower plates, and the other of said guide post and said cylinder is mounted in laterally translatable relation to the other of said upper and lower plates to accommodate lateral relative displacement between said upper and lower plates due to different thermal expansion thereof, thereby preventing binding of said guide post within said cylinder.

14. The guidance device as recited in claim 13, wherein said cylinder is translatably mounted to said lower plate.

15. The guidance device as recited in claim 14, further including a rectangular mounting block having a mounting flange that is fastened to said lower plate, wherein said cylinder is mounted within said rectangular mounting block and is laterally translatable therein.

16. The guidance device as recited in claim 14, further including a mounting flange attached to said cylinder and mounted against said lower plate and retainer blocks that are attached to said lower plate and that loosely capture said mounting flange therebetween to permit said cylinder to be laterally translatable with respect to said lower plate.

17. The guidance device as recited in claim 14, wherein said lower plate includes at least one aperture therethrough, and said guidance device further includes a T-shaped mounting flange attached to said cylinder and mounted against said lower plate and extends at least partially through said at least one aperture of said lower plate, said guidance device further includes retainer blocks that are attached to said lower plate and that loosely capture said T-shaped mounting flange therebetween to permit said cylinder to be laterally translatable with respect to said lower plate.

* * * * *